US009206015B2

(12) United States Patent
Osmanbasic et al.

(10) Patent No.: US 9,206,015 B2
(45) Date of Patent: Dec. 8, 2015

(54) SAFETY BRAKE WITH RESETTING

(71) Applicant: INVENTIO AG, Hergiswil NW (CH)

(72) Inventors: Faruk Osmanbasic, Cham (CH); Nicolas Gremaud, Richterswil (CH); Michael Geisshusler, Lucerne (CH)

(73) Assignee: Inventio AG, Hergiswil (CH)

( * ) Notice: Subject to any disclaimer, the term of this patent is extended or adjusted under 35 U.S.C. 154(b) by 573 days.

(21) Appl. No.: 13/687,488

(22) Filed: Nov. 28, 2012

(65) Prior Publication Data

US 2013/0133984 A1 May 30, 2013

(30) Foreign Application Priority Data

Nov. 29, 2011 (EP) ..... 11191102

(51) Int. Cl.
*B66B 1/32* (2006.01)
*B66B 5/16* (2006.01)
*B66B 5/18* (2006.01)

(52) U.S. Cl.
CPC .... *B66B 5/16* (2013.01); *B66B 5/18* (2013.01)

(58) Field of Classification Search
CPC ..... B66B 5/15; B66B 5/18
USPC ..... 187/251, 277, 288, 351, 359, 371–376
See application file for complete search history.

(56) References Cited

U.S. PATENT DOCUMENTS

| | | | | |
|---|---|---|---|---|
| 4,548,298 | A * | 10/1985 | Born | 187/268 |
| 5,467,850 | A * | 11/1995 | Skalski | 188/165 |
| 8,312,972 | B2 * | 11/2012 | Gremaud et al. | 187/372 |
| 8,517,150 | B2 * | 8/2013 | Grundmann et al. | 187/359 |
| 2007/0007083 | A1 | 1/2007 | Husmann | |
| 2008/0128218 | A1 | 6/2008 | Gremaud et al. | |
| 2012/0222918 | A1 * | 9/2012 | Billard et al. | 187/359 |
| 2013/0081907 | A1 * | 4/2013 | Meierhans et al. | 187/359 |
| 2013/0248296 | A1 * | 9/2013 | Husmann | 187/251 |
| 2014/0008157 | A1 * | 1/2014 | Terry et al. | 187/359 |

* cited by examiner

*Primary Examiner* — Anthony Salata
(74) *Attorney, Agent, or Firm* — Fraser Clemens Martin & Miller LLC; William J. Clemens

(57) ABSTRACT

In an elevator installation an elevator cage is arranged to be movable along guide rails and the elevator cage is equipped with a brake system possibly with two safety brakes. The safety device is activated by way of control devices which can trigger the safety device from critical or non-critical events. The control devices further include a function for automatic resetting of the safety brake when an event, which is evaluated as non-critical, is indicated as a reason for triggering the safety brake. Resetting of the safety brake takes place through execution of pre-defined resetting steps of the elevator cage.

20 Claims, 6 Drawing Sheets

SAFETY BRAKE WITH RESETTING

CROSS-REFERENCE TO RELATED APPLICATION

This application claims priority to European Patent Application No. 11191102.0, filed Nov. 29, 2011, which is incorporated herein by reference.

FIELD

The disclosure relates to elevator safety brakes.

BACKGROUND

The elevator installation is installed in a building. It substantially consists of a cage which is connected by way of support means with a counterweight or with a second cage. The cage is moved along substantially vertical guide rails by means of a drive which acts selectably on the support means or directly on the cage or the counterweight. The elevator installation is used in order to convey persons and objects within the building over individual or several stories. The elevator installation includes devices in order to safeguard the elevator cage in the case of failure of the drive or of the support means. For that purpose, use is usually made of safety brakes which in the case of need can brake the elevator cage on the guide rails.

Safety brakes with an electromechanical retaining device are currently known, which device in an activated state can hold the safety brake in a readiness setting and which in a deactivated state releases the safety brake for braking.

SUMMARY

At least some embodiments comprise a method and a corresponding safety device in order to place a safety brake back in operation, for example in the case of a more lengthy interruption of energy or also after another switching-off not due to safety issues.

According to some embodiments, the elevator installation is equipped with a safety device. This comprises a safety brake which is provided with a safety switch which interrupts a brake safety circuit when the safety brake is released for braking. The safety device further comprises a brake safety control which when required releases the safety brake for braking if on the one hand a fault or a critical event is detected in the elevator installation or also if on the other hand an event evaluated as non-critical occurs. An event assessed as non-critical is, for example, an energy interruption in the building or switching-off of an elevator over a longer period of time or also an event carried out for the purpose of a test. The brake safety control stores, in the case of releasing of the safety brake for braking, possibly the cause, or the event, of releasing the safety brake. As soon as the elevator control on the one hand recognizes that an elevator safety circuit or the brake safety circuit is interrupted and on the other hand a non-critical cause for releasing the safety brake is reported by the brake safety control, the elevator control initiates an automatic resetting of the safety brake. Automatic means that the process of resetting the safety brake is initiated substantially without human assistance.

According to further embodiments, the safety brake of a travel body of the elevator installation is provided with a possibly electromechanical retaining device, which in a deactivated state releases the safety brake for braking. After releasing of the safety brake the safety brake is possibly reset in that in a first step the travel body is moved in a first travel direction. The safety brake is thereby at least partly stressed or at most re-stressed. At the same time or in the time period before or after this first movement the retaining device of the safety brake is activated in order to prepare it for retention of the safety brake in its readiness setting. The travel body is subsequently moved in a second travel direction opposite the first travel direction. The safety brake is thereby brought into the readiness setting where it is held by the activated retaining device. The safety brake is thus again in its readiness setting. Possibly, this resetting can be carried out in an at least partly automated process. The procedure has the effect that the safety brake initially comes into a clamping region independently of an instantaneous engagement state. In the clamping region a bias is generated in the safety brake, which enables return guidance of the retaining device and the braking elements of the safety brake into the readiness setting.

If, for example, the safety brake as a consequence of a lengthy energy failure in the building has been activated, i.e. the retaining device deactivated, then, for example, a braking element of the safety brake has been adjusted relative to the rail. Since, however, no cage movement or no movement of a travel body takes place—since, of course, no energy is present in the building—the safety bake is not actually engaged. Accordingly, the safety brake is also not stressed. Since, however, in the case of at least some safety brakes a resetting of the holding or safety brake into the readiness setting can take place by a relative movement between safety brake and brake rail, this resetting cannot act, since the safety brake is still not stressed. Through the selective travel movements carried out the safety brake is stressed in a first movement and reset into the readiness setting in a second movement.

Generally, a downward travel direction is used as a first travel direction and correspondingly an upward travel direction is used as a second travel direction. This can be advantageous, since many elevator installations are provided merely with a safety brake for safeguarding against crashing down of the travel body. With selection of the downward travel direction as first travel direction a selection is thus defined which is appropriately usable for all elevator installations. In addition, a maximum breakaway force is then available for movement in the second travel direction, since usually in an operating situation of that kind the elevator cage is empty and thus an excess weight of the counterweight is available for the movement.

The retaining device of the safety brake is possibly activated prior to movement of the travel body in the second travel direction. Due to this preceding activation of the retaining device an accurate determination of the time of activation is superfluous. Since the retaining device attains its activated state sometime in the course of the cage movement it is directly held in the case of preceding switching on. Possibly, the retaining device of the safety brake is activated already before movement of the travel body in the first travel direction. A preparatory testing and preparing algorithm is thereby able to be of simple design.

The movement of the travel body in the first travel direction is possibly carried out until the safety brake at least partly clamps on a brake surface provided for the braking. The brake surface provided for the braking is usually a brake rail or a guide web of a guide rail, which is at the same time the brake rail. It can be ensured by this first movement of the travel body that the safety brake has a minimum biasing or that it is at least partly clamped on the brake rail.

The at least partial clamping, which is carried out, of the safety brake on the brake surface provided for braking is possibly detected in that either a travel path of the travel body is ascertained, possibly by means of measuring a rotational movement of the drive pulley, and compared with a travel target preset. As soon as the travel body has covered a defined travel path, which is usually determined experimentally, it can be assumed therefrom that a partial clamping of the safety brake has taken place. Usual elevator drives already have measuring systems such as tachometers or incremental transmitters on the drive shaft in order to ascertain a travel path on the basis of the rotational movement of the drive pulley.

Alternatively or additionally a drive torque of the drive engine can be detected, possibly by means of measurement of the drive current, wherein this drive torque is compared with a target torque. As soon as the drive torque reaches or exceeds a pre-defined value it can be assumed therefrom that an at least partial clamping of the safety brake has taken place. This embodiment can be particularly reliable, since the drive torque provides a direct reference to the clamping that has taken place.

Alternatively, a time duration for the movement of the travel body in the first travel direction can also be ascertained and compared with a limit time value. Here, too, the required time duration can be determined experimentally. This embodiment can be a particularly economic embodiment, since no special sensors are required.

In some cases, subsequently to the first movement of the travel body the movement of the travel body in the second travel direction is carried out. This second movement is carried out until the brake safety circuit is closed and the travel body has covered a pre-defined travel path. Closing of the brake safety circuit usually indicates that the safety brake is again in its readiness setting. In addition, it can be ensured by the travel path which is covered that all components of the safety brake and at most the entire travel body are free.

Alternatively or additionally, the drive torque of the drive engine is also monitored and the movement of the travel body in the second travel direction is ended if the drive torque attains an indicator value. A substantial drive torque is usually required for movement of the travel body in the second travel direction, since the safety brake has to be moved out of its clamping position. It can now be established by the measurement if the drive torque or the start-off torque exceeds a peak value and then returns to a substantially constant value or into the range of the indicator value.

In some embodiments, termination criteria are defined which terminate or at least interrupt the movement of the travel body in the second travel direction if, for example, the drive torque of the drive engine reaches or exceeds a maximum limit value. A time limit can be attached to this limit value. This means that the movement of the travel body in the second travel direction is terminated if the drive torque of the drive engine exceeds a working limit value during a predefined time limit. Alternatively, a time limit duration can also be predetermined for time limitation of the second movement.

The movement of the travel body in the second travel direction is possibly similarly terminated if a limit position of the travel body in the elevator shaft is passed or obviously also if an unsafe state of the elevator installation is detected. For example, if on occasion an electronic speed limiter ascertains an excessive speed the retaining device of the safety brake is deactivated again which in every case leads to direct actuation of the brake regardless of the instantaneous reset status. Thus, special events can be taken into consideration in the resetting. Thus, for example, an energy failure in the building can coincidentally take place when the elevator cage or the travel body is entirely at the top or at the bottom in an extreme position or in a limit position near a shaft end in the elevator shaft. Since the elevator cage in this situation can already be located near the shaft end it is obviously not possible for a large movement to take place in one of the travel directions. In individual cases of that kind possible damage can be prevented by the termination criteria.

The resetting steps are possibly selectively repeated if after conclusion or after termination of the movement of the travel body in the second travel direction has taken place the brake safety circuit is not closed. This can be helpful if, for example, in the case of a first resetting attempt a start-off torque is not sufficient to break loose the travel body or the safety brake. The resetting process can then selectively be initiated again. This can, for example, be repeated two to three times. To the extent that after these multiple attempts the resetting cannot be successfully concluded, automatic resetting is possibly terminated. The resetting procedure can then be initiated again, for example, only by an authorized person such as a service engineer.

The readiness setting of the safety brake is possibly monitored and a brake safety circuit of the elevator installation is closed if the safety brake in the readiness setting thereof and the retaining device are activated. The brake safety circuit of the elevator installation otherwise is or remains interrupted as long as the safety brake or the retaining device is not in the readiness setting thereof. It can thus be ensured that the elevator installation cannot transition into normal operation as long as the safety brake is not in its readiness setting.

The elevator safety circuit is possibly checked before movement of the travel body in the first travel direction and the movement in the first travel direction is executed only when predetermined parts of the elevator safety circuit have been found to be in order. Safety of the elevator installation and any users in the environment of the elevator installation is thereby ensured. The elevator safety circuit is, for example, opened when accesses to the elevator shaft are not closed or if important functional parts such as, for example, a cable tension, a buffer device, a position detection device or the speed measuring device, etc., are not functionally capable. The predetermined parts of the elevator safety circuit possibly include, with the exception of the brake safety circuit, all remaining parts of the elevator safety circuit. The brake safety circuit is possibly bridged over, since it is obviously open, because the safety brake is no longer in the readiness setting thereof when the retaining device is deactivated. Thus, it is necessary to exclude this part of the elevator safety circuit for the assessment for starting the resetting.

In some embodiments, in a first step prior to performance of the resetting steps a fault status of a brake control is interrogated and the appropriate procedure is selected in dependence on the fault status.

The resetting steps can, for example, be automatically initiated if the retaining device as a consequence of the event evaluated as non-critical was deactivated and at the same time the safety circuit of the elevator installation designates the significant parts of the elevator installation as safe. Non-critical events are, for example, an intentional deactivation of the retaining device as a consequence of an energy failure in order to save energy when the elevator installation is at a standstill or if as a consequence of a self-test a deactivation of the retaining device takes place. Automatic initiation of the resetting steps signifies that a control, for example an elevator control, generates and executes an appropriate travel command by the drive of the elevator installation being appropriately controlled.

The resetting steps can on the other hand also be manually initiated if the retaining device was not deactivated as a consequence of an event evaluated as non-critical or if the safety circuit of the elevator installation does not designate the installation as safe. This means that assessment by a qualified or an authorized person is required. This person assesses the state of the elevator, instigates necessary repairs or on occasion even carries these out himself or herself. After the state of the elevator installation has been assessed by the authorized person as safe, he or she can by way of appropriate commands initiate resetting of the safety device or the safety brake, wherein then these resetting steps are selectably directly carried out by the authorized person or that person merely gives release for automatic initiation of the resetting steps. Through this method the safety of the elevator installation can be guaranteed to the best possible extent at any time and at the same time the elevator installation is not unnecessarily taken out of operation.

Manual initiation of the resetting steps is, as explained in the preceding, possibly carried out by an authorized person. In this regard, an authorization of the authorized person is checked in order to establish whether the person is actually authorized to perform the required actions competently. For this purpose, for example, an authorization code has to be input into the brake control or into the elevator control. In a simple check the control can establish whether this authorization code corresponds with the presets. This authorization code can be a code recorded in the service documents or it can correspond with a part of an identification number of the brake control.

Alternatively, a pre-defined command and action cycle for checking the authorization can also be used. This is, for example, a double actuation of an elevator call button followed by an actuation of a control button within a predetermined time.

Alternatively, a possibly personal key can also be connected with the brake control or the elevator control. The key can be a mechanical key by which access to specific functions of the elevator is made possible. It can also be an electronic key such as an electronic card, etc., by which access to specific functions of the elevator is made possible. The various solutions allow attainment of a level of safety and serviceability matched to the elevator installation.

Manual initiation of the resetting steps possibly includes manual actuation of the status of the brake control. This means that the authorized person has to acknowledge the status or fault status stored in the brake control, after assessment and repair. Subsequently, a manual movement of the travel body is carried out, possibly directly by the authorized person, by means of actuation of the elevator drive in a first travel direction and a subsequent Manual movement of the travel body in the second travel direction opposite the first travel direction. In this regard, the authorized person has complete control over the movement state. The person can immediately terminate the travels at any time if irregularities are ascertained.

The required control functions are possibly divided up between the elevator control and the brake control. Thus, the brake control, which possibly also includes a so-termed electronic speed limiter or is connected with such, for example the control of the retaining device, includes a device for bridging over the brake safety circuit and a communications interface with respect to the elevator control. The brake control deactivates the retaining device of the safety brake in a fault case, for example excess speed, and opens the associated part of the safety circuit of the elevator. However, it deactivates, for example, the retaining device of the safety brake also when the energy supply is interrupted over a predetermined longer period of time or when other events assessed as non-critical occur. The brake control stores this trigger event as non-critical in a non-volatile memory.

The elevator control includes the parts required for control of the elevator, in particular it is in a position of activating the elevator drive for movement of the travel body of the elevator and in a position of communicating with the brake control. After switching-off of the entire elevator, for example if an energy mains of the building is switched off, the entire elevator is in a current-free state and the brake control deactivates, in accordance with definition, the retaining device of the safety brake. After switching back on of the energy supply to the elevator the elevator control ascertains an interruption of the safety circuit at the safety brake, whereby starting-off of the elevator is prevented. The brake control checks the actual safety status and on the one hand establishes—for example by means of a self-test function—that the function of the control and of the, for example integrated, electronic speed limiter is available and further establishes that the cause of switching-off was non-critical, since a corresponding entry was filed in the non-volatile memory. The brake control passes on this information to the elevator control, which now initiates resetting of the safety brake. The elevator control checks the status of the rest of the safety circuit and then triggers the corresponding resetting steps.

The aforesaid method and the corresponding safety device can enable provision of a safer elevator installation which can operate with minimum energy resources and which is nevertheless rapidly serviceable again in the case of specific events or after specific events.

BRIEF DESCRIPTION OF THE DRAWINGS

Exemplifying embodiments are explained in the following by way of examples and schematic embodiments, in which.

The same references are used in the figures for equivalent parts in all figures.

DETAILED DESCRIPTION

Figure 1:
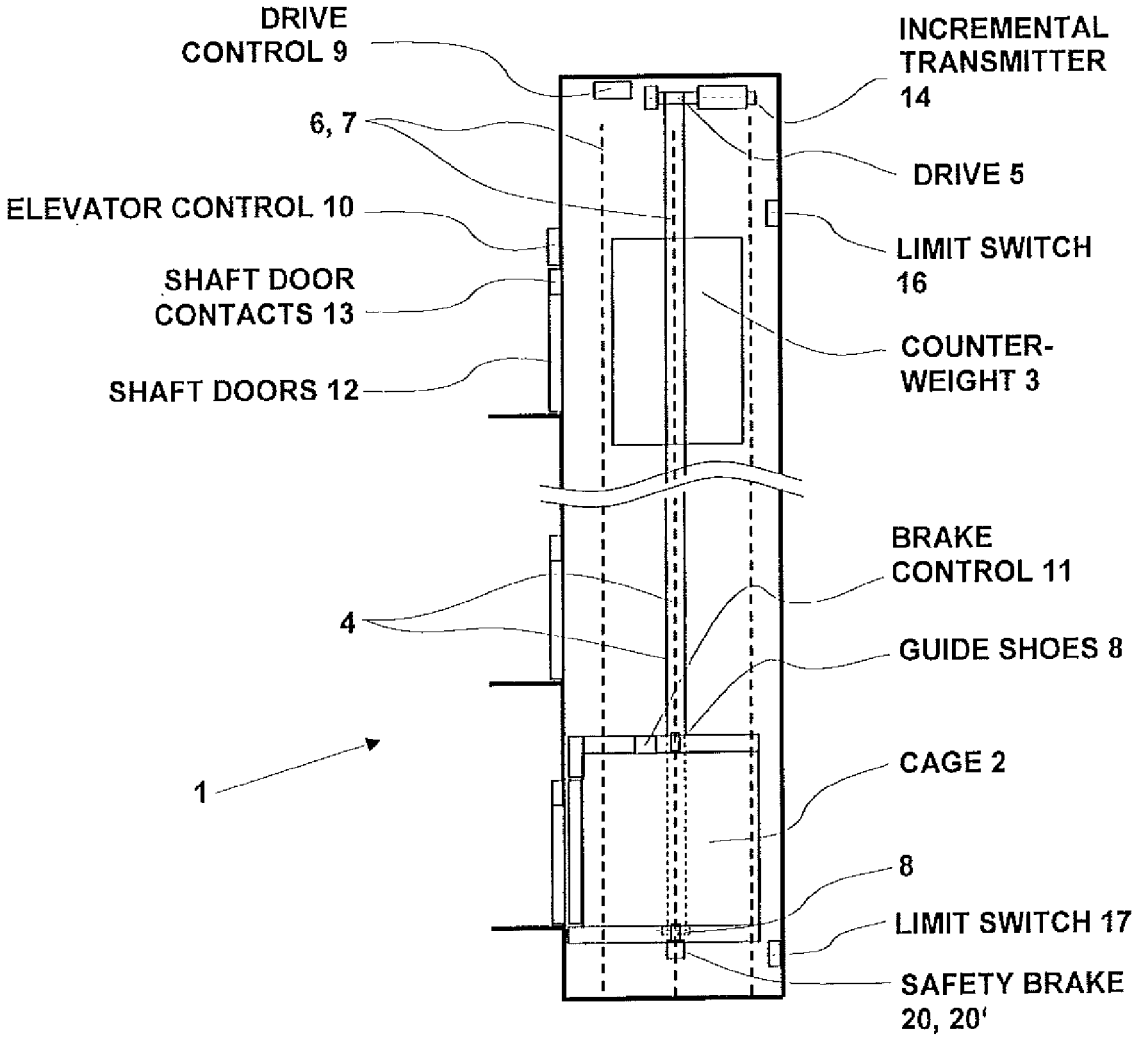
FIG. 1 shows a schematic view of an elevator installation in side view.

FIG. 1 shows an elevator installation 1 in an overall view. The elevator installation 1 is installed in a building and serves for the transport for persons or articles within the building. The elevator installation comprises an elevator cage 2 which can move upwardly and downwardly along guide rails 6. The elevator cage 2 is for that purpose provided with guide shoes 8 which guide the elevator cage along a predetermined travel path. The elevator cage 2 is accessible from the building by way of shaft doors 12. A drive 5 serves for driving and holding the elevator cage 2. The drive 5 is arranged in, for example, the upper region of the building and the cage 2 hangs by support means 4, for example support cables or support belts, at the drive 5. The support means 4 are led by way of the drive 5 onward to a counterweight 3. The counterweight compensates for a mass component of the elevator cage 2 so that the drive 5 primarily merely has to compensate for an imbalance between cage 2 and counterweight 3. In the example, the drive 5 is arranged in the upper region of the building. It could also be arranged at another location in the building or in the region of the cage 2 or the counterweight 3.

The elevator installation 1 is controlled by an elevator control 10. The elevator control 10 receives user requests, optimizes the operational course of the elevator installation and controls, usually by way of a drive control 9, the drive 5. The drive 5 is equipped with an encoder or incremental transmitter 14. A rotational movement of an axle of the drive can thus be detected and communicated to the drive control 9 for the purpose of regulation of the drive. This incremental transmitter 14 can also be used for detecting the travel path of the elevator cage 2 and thus for regulation and control thereof. The elevator control 10 additionally monitors the safety state of the elevator installation and interrupts the travel operation if an unsafe operational state arises. This monitoring is usually performed with use of an elevator safety circuit in which all safety-relevant functions are integrated. In monitoring of that kind or in this elevator safety circuit there are also incorporated, for example, shaft door contacts 13, which monitor correct closing of the shaft doors 12 and, for example, also limit positions of the travel body 2, 3 in the elevator shaft are monitored by means of upper and lower limit switches 16, 17.

The elevator cage 2 and, if required, also the counterweight 3 are further equipped with a brake system suitable for safeguarding and/or retarding the elevator cage 2 in the case of an unexpected movement or in the case of excess speed. In the example, the brake system comprises two identical safety brakes 20, 20' which are installed on the travel body 2, 3 at both sides thereof. The safety brakes 20, 20' are, in the example, arranged below the cage 2 and they are electrically activated by way of a brake control 11. This brake control 11 possibly also includes an electronic speed or travel plot limiter which monitors travel movements of the elevator cage 2. A speed limiter, as is usually used, can accordingly be eliminated.

Figure 2:
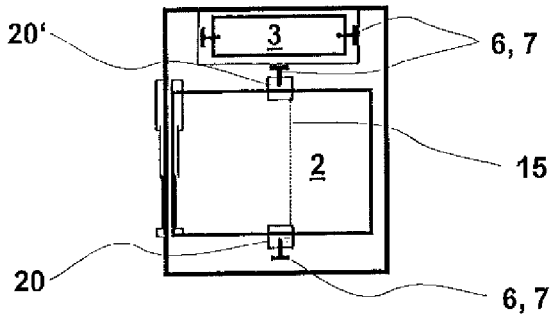
FIG. 2 shows a schematic view of the elevator installation in cross-section.

FIG. 2 shows the elevator installation of FIG. 1 in a schematic plan view. The brake system comprises the two safety brakes 20, 20'. The two safety brakes 20, 20' are, in this example, coupled by means of a synchronization rod 15 so that the two safety brakes 20, 20' are necessarily actuated together. An unintended one-sided braking can thus be avoided. The two safety brakes 20, 20' are possibly constructed to be identical or in mirror symmetry and they act on the brake rails 7 arranged on either side of the cage 2. The brake rails 7 are, in the example, identical with the guide rails 6.

It is also possible to dispense with the synchronization rod 15. However, electrical synchronization means, which ensure simultaneous triggering of safety brakes 20, 20' arranged on either side of the elevator cage, can also be used.

Figures 7F, 7S:
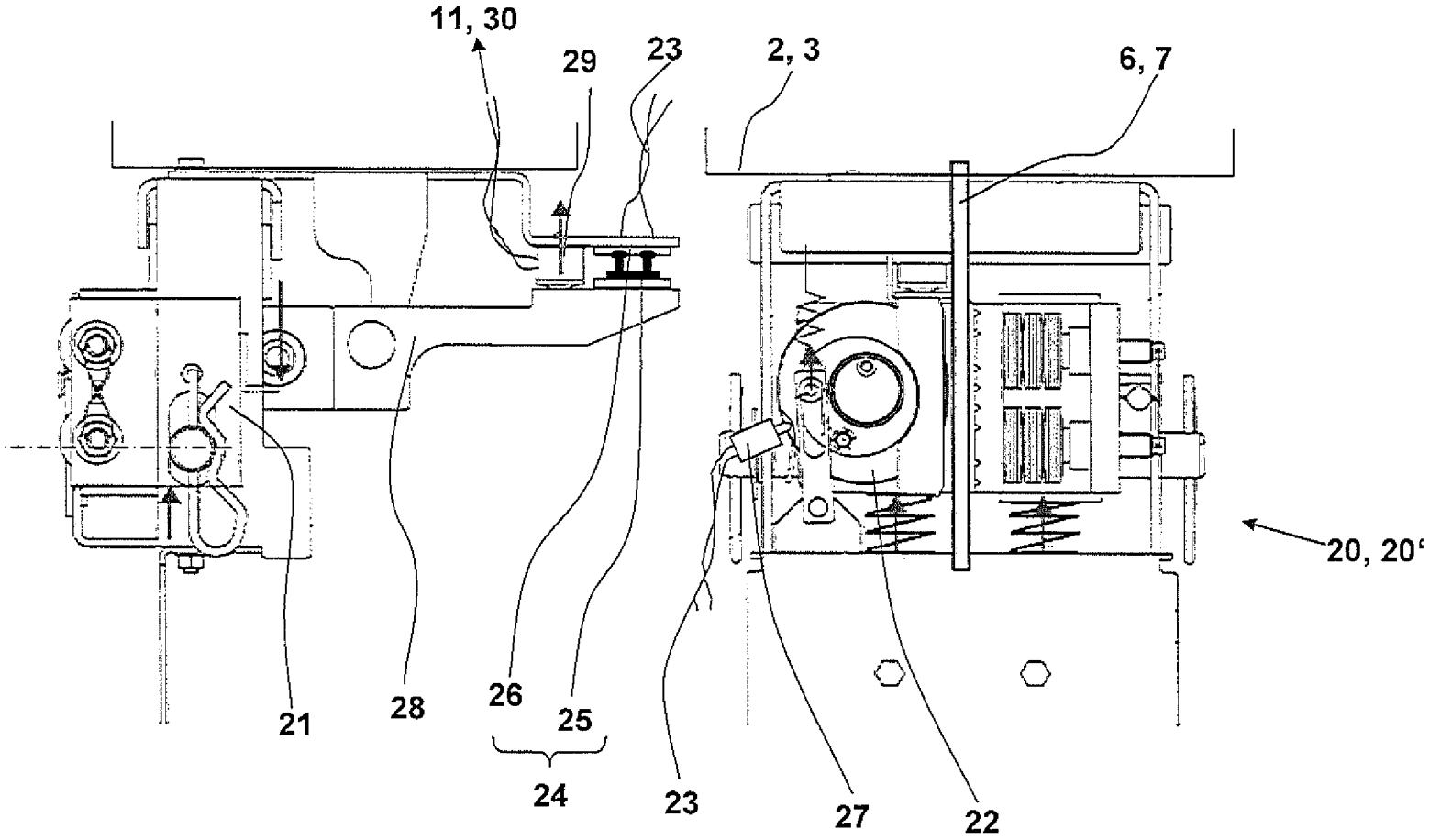
FIG. 7*s* shows a side view of an embodiment of a safety brake in a first, unactuated position.
FIG. 7*f* shows a front view of the safety brake of FIG. 7*s*.
Figure 8F:
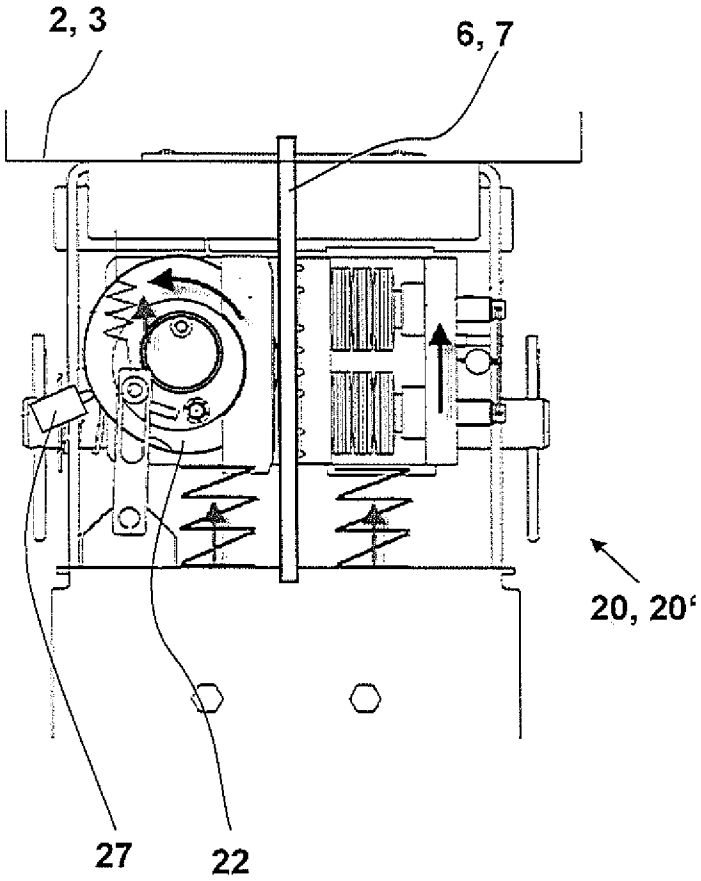
FIG. 8*f* shows a front view of the safety brake of FIG. 8*s*.
Figure 8S:
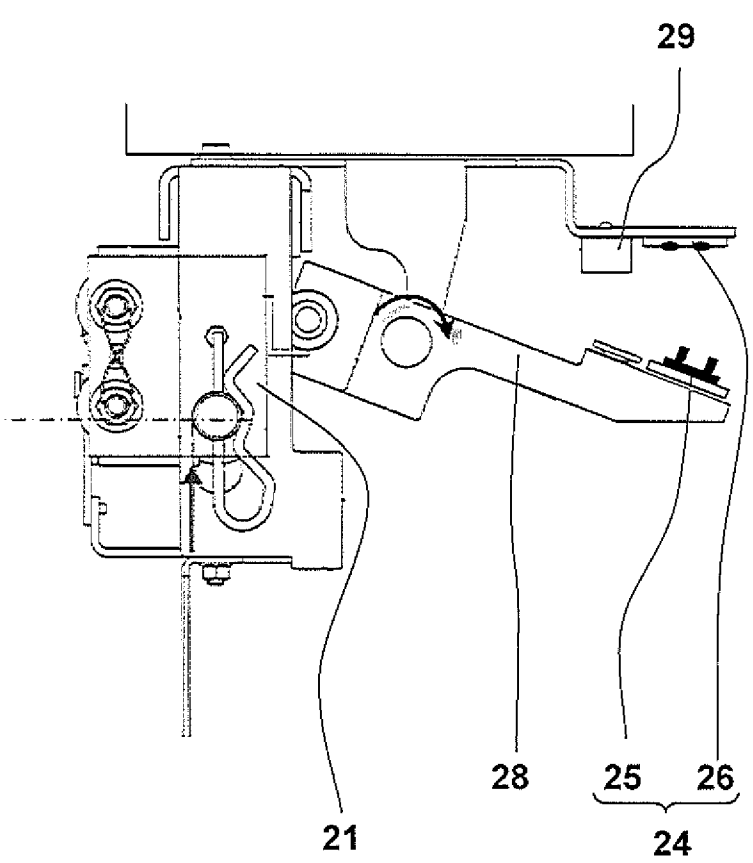
FIG. 8*s* shows a side view of the safety brake of FIG. 7*s* in a second, actuated position

One possible example of the safety brake 20, 20' is shown in FIGS. 7 and 8 and explained in the following. The two safety brakes 20, 20' are functionally identical, for which reason there is discussion in the following merely of the safety brake 20. The safety brake 20 comprises a brake housing 21 with a brake element 22. The brake housing 21 is held by a retaining device 28 in a readiness setting (FIGS. 7*s*, 7*f*). The retaining device 28 is for that purpose fixed by means of a retaining magnet 29. This position of the retaining magnet 28 is controlled by a first brake contact 24. In the example, the first brake contact 24 comprises a contact bridge 25 and contact locations 26, which are led to a brake safety circuit 23. Alternatively or additionally, the readiness setting of the safety brake 20 can also be checked by way of a second brake contact 27. This second brake contact 27 monitors, in the example, the brake element 22 and this second brake contact 27 is also connected, on occasion in series with the first brake contact 24, with the brake safety circuit 23. The retaining magnet 29 is connected with the brake control 11 and with corresponding energy sources 30 and is controlled by the brake control 11.

As soon as the brake control 11 deactivates the retaining magnet 29 (FIGS. 8*s*, 8*f*) the safety brake 20 is displaced into its braking position, wherein the brake element 22 is brought into contact with the brake or guide rail 6, 7. Insofar as the elevator cage continues to move in relation to the brake or guide rail 6, 7, this leads to a further engagement of the safety brake 20 and ultimately to secure braking of the elevator cage 2. With deactivation of the retaining magnet 29 or of the retaining device 28 the first brake contact 24 is interrupted, the optional second brake contact 27 is also interrupted through the movement of the brake housing 21 and the brake element 22 and the brake safety circuit 23 is interrupted, whereby operation of the elevator installation 1 is discontinued.

Figure 6:
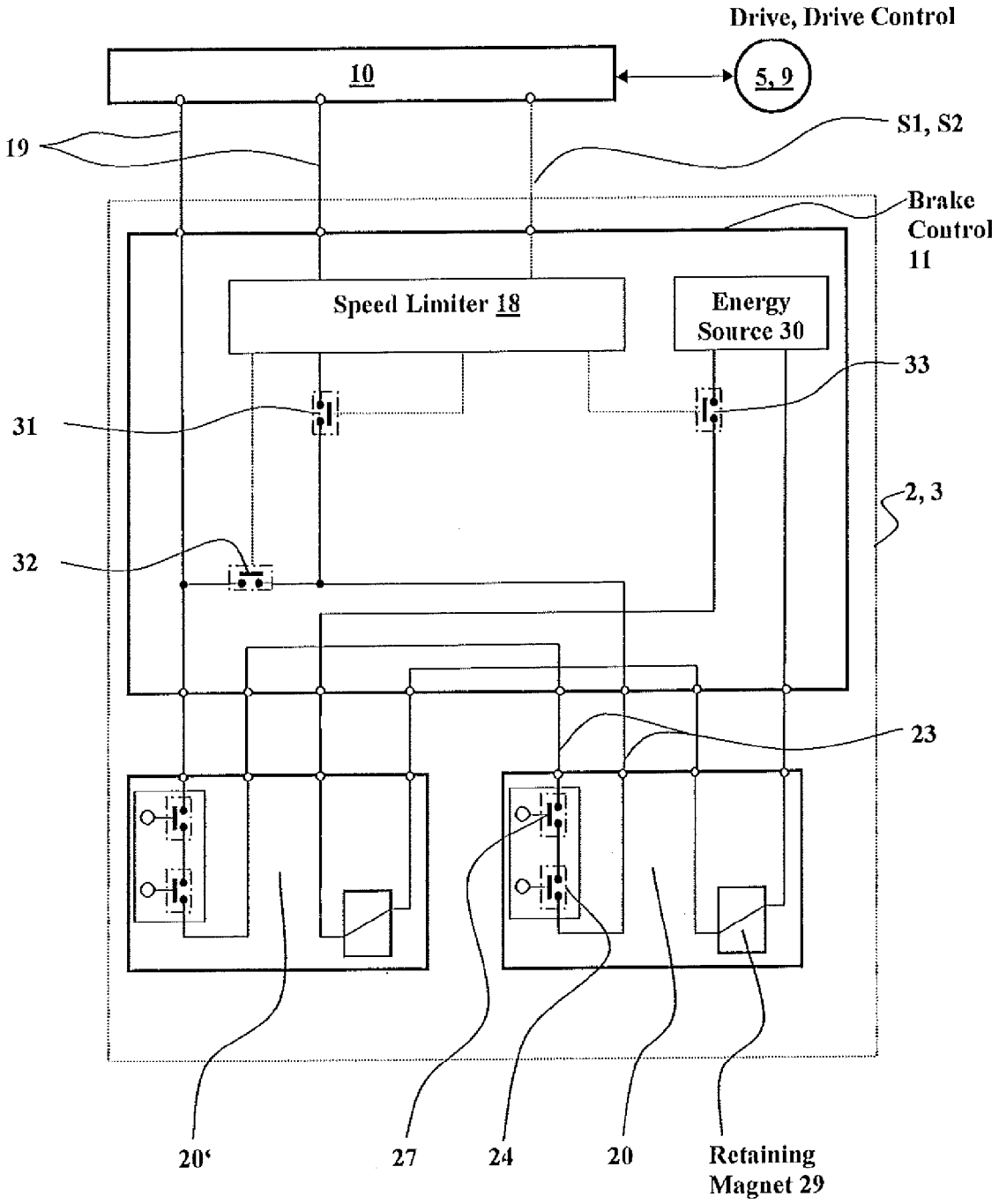
FIG. 6 shows a schematic illustration of an electrically linked safety system.

FIG. 6 shows a possible circuit diagram of an electrically coupled brake system. The brake contacts 24, 27 of the two safety brakes 20, 20' are, in the example, connected in series and led as brake safety circuit 23 to the brake control 11. The state of the brake safety circuit 23 is evaluated in the brake control 11 and integrated in the elevator safety circuit 19. The brake control 11 includes an electronic speed limiter 18 which on the one hand monitors travel operation and a general state of the list installation. The retaining magnets 29 of the two safety brakes 20, 20' are, in the example, similarly connected in series and led to the brake control 11, from wherein the retaining magnets 29 can be controlled and caused to conduct current by an energy source 30. Through the series circuit it is achieved that in the case of interruption of the electrical line both or all retaining magnets 29 of the safety brakes 20 are necessarily deactivated. The series circuit is possibly executed in the brake control 11. This means that the retaining magnets 29 of the two safety brakes 20, 20' are separately connected with the brake control and the series circuit is executed in the brake control 11.

The electronic speed limiter 18 can now, if required, interrupt not only the elevator safety circuit 19, but also the holding current circuit of the retaining magnets 29, whereby the safety brake 20 is released for braking.

If the speed limiter 18 in a first case ascertains, for example, an excessive travel speed it interrupts the holding current circuit of the retaining magnet 29, whereby the elevator cage 2 is braked. At the same time it interrupts, through opening of a first interrupter 31, the elevator safety circuit 19, whereupon the elevator control 10 brakes and shuts down the drive 5 of the elevator installation. The speed limiter 18 stores the cause of the actuation as relevant or critical and provides the appropriate fault status signal S1 in a non-volatile memory.

If, in another case, the speed limiter 18 ascertains that the brake safety circuit 23 has, for example, opened without apparent reason, it interrupts the holding current circuit of the retaining magnet 29 and the elevator safety circuit 19 and thus stops the elevator installation. It is thus achieved that in the case of an erroneous triggering of one of the safety brakes 20, 20' the second safety brake 20', 20 is also immediately actuated. A one-sided braking is thus prevented. The speed limiter 18 stores the cause of the actuation as relevant or critical and provides the appropriate fault status signal S1 in the non-volatile memory.

If, in a further case, the speed limiter 18 ascertains that, for example, the stopped elevator installation is or is to be at standstill over a longer period of time it similarly interrupts the holding current circuit of the retaining magnet 29, although no relevant fault is present in the elevator installation. The retaining device 28 is thereby released and the safety brake 20 is moved into the braking position without, however, braking, since the elevator cage is at standstill and thus the safety brake 20 is not re-tightened. The speed limiter 18 stores the cause of the actuation as non-relevant or as non-critical and provides the appropriate fault status signal S1 in the non-volatile memory.

Moreover, the electronic speed limiter 18 can, on corresponding request, bridge over the brake safety circuit 23 by a bridge contact 32 in order to enable, in accordance with need, a controlled movement of the elevator cage 2.

In this last-illustrated case, the safety brake 20 is correspondingly adjusted into a brake readiness position and the retaining device 28 is deactivated. Correspondingly, the brake safety circuit 23 is also interrupted and the elevator safety circuit 19 is also interrupted, on the one hand by the brake safety circuit 23, but also by opening the first interrupter 31.

If in this case the energy supply of the building or the elevator installation is switched back on, the elevator control 10 ascertains, after possible self-testing and initialization routines have been run through, that the elevator safety circuit 19 is interrupted, in particular in the region of the cage safety system. The elevator control now starts, as illustrated in FIG. 4, an event analysis F. At the same time with the switching-on of the current supply, the brake control 11 has also run through possible internal tests and initialization routines and has ascertained that in accordance with the stored fault status signal S1 the cause of the actuation was determined to be non-relevant or non-critical and that a function of the brake control S2 itself is evaluated as intact. The elevator control interrogates the fault status signal S1 and the function readiness report S2 in the event analysis F and determines the further procedure therefrom. To the extent that the signal S1 communicates the report "non-critical" and the signal S2 communicates the report "functional test passed" the elevator control 10 starts, insofar as remaining parts of the elevator safety circuit 19 are in order, an automatic resetting A, which is explained in more detail in the following under FIG. 3. Otherwise, further operation of the elevator installation remains interrupted until a manual resetting M is carried out, as is explained later with reference to FIG. 5.

After start of the automatic resetting A (FIG. 3), in the example the functional integrity S2 of the brake control 11 as well as remaining parts of the elevator safety circuit 19 is checked R0.1 and, in the case of a positive result "yes" an optional indication D2 or notification in the region of stories or in the cage 2 is, for example, issued, which indicates that a resetting travel will shortly be carried out. Subsequently, the brake control 11 closes, after corresponding instruction by the elevator control 10, the first interrupter 31 of the elevator safety circuit 19 and temporarily bridges over the brake safety circuit 23. At the same time, the retaining device 28 of the safety brake is activated R1 in that a second interrupter 33 of the retaining device is closed and the retaining magnet 29 is current-conducting in order to prepare the retaining device 28 for holding the safety brake 20 in the readiness setting.

The elevator control 10 subsequently gives corresponding travel commands in order to move R2 the cage 2 or on occasion the counterweight 3 in a first travel direction at a possibly low speed. The safety brake, which before the movement was merely adjusted against the rails 6, 7, but not actually clamped, is thus at least partly tightened or re-tightened. This movement in the first travel direction is possibly carried out until the safety brake at least partly clamps R2.1 on the brake surface, which is provided for braking, of a brake or guide rail. The clamping R2.1 which has been carried out can, for example, be ascertained in that a travel path of the travel body is ascertained, possibly by means of the signals of the incremental transmitter 14, and compared with a travel target preset. Alternatively or additionally a drive torque of the drive motor can also be ascertained, possibly by means of measuring the drive current, and compared with a target torque or also a time duration for the movement of the travel body in the first travel direction can simply be ascertained and compared with a limit time value.

Subsequently to the first movement R2 in the first travel direction the elevator control 10 predetermines a reversal of the travel direction and the drive 5 correspondingly moves the elevator cage or the counterweight in the opposite, second travel direction R3.

Through the movement R2 in the first travel direction the safety brake was brought into place for clamping with the rail. On occasion, depending on the respective form of construction of the safety brake 20, the retaining device 28 could also thereby be already brought into the holding position. The safety brake is reset into the actual operating position by the second movement R3. This second movement R3 in the second travel direction is basically continued until the safety brake has been reset R3.1. This can usually be ascertained in simple manner in that, for example, it is checked whether the safety brake circuit 23 is closed, thus the safety brake 20 is in the readiness setting, or in that a travel path is measured or in that the drive torque of the drive motor is measured. As soon as the drive torque has attained an indicator value, which usually corresponds with the constant movement moment of the empty cage, the safety brake 20 is free, thus no longer in clamping state.

Figure 3:
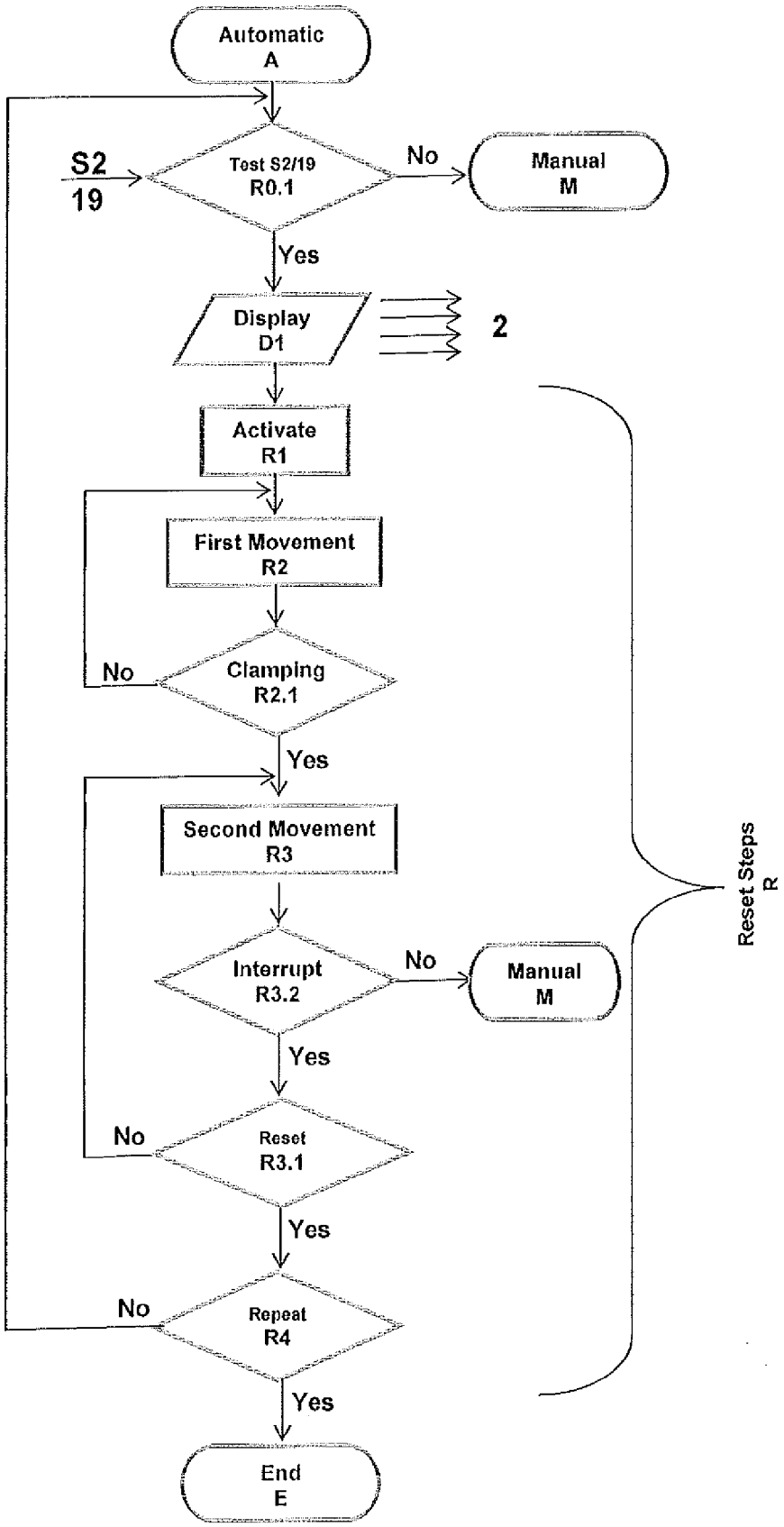
FIG. 3 shows a schematic flow chart of resetting of a safety brake.
Figure 4:
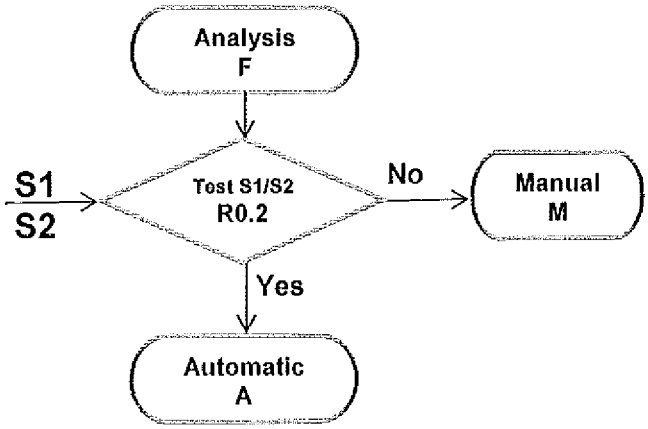
FIG. 4 shows a schematic flow chart for initiation of resetting.

In the sequence according to FIG. 3 there is monitoring, by way of example, above all of the movement in the second travel direction in that every journey is interrupted R3.2 if an unsafe state of the elevator installation is recognized. This monitoring possibly applies during every travel movement. Thus, in particular, the travel is interrupted if, for example, the drive torque of the drive motor reaches a maximum limit value, if the drive torque of the drive motor exceeds a working limit value during a time limit, if a limit time period is reached, if limit positions of the travel body in the elevator shaft are passed or if the elevator safety circuit 19 detects another unsafe state. In these cases, usually a manual resetting M is initiated or demanded.

The steps of the resetting R of the safety brake 20 thus include activating R1 of the retaining device of the safety brake in order to prepare it for holding the safety brake in a readiness setting, a movement of the travel body in a first travel direction R2 in order to at least partly tighten or re-tighten the safety brake and a movement of the travel body in a second travel direction R3, which is opposite the first travel direction, in order to bring the safety brake into the readiness setting, where it is held by the activated retaining device.

In the example of FIG. 3 the resetting steps R are possibly selectively repeated R4 is after conclusion of the movement of the travel body in the second travel direction the brake safety circuit is still not closed, but no fault in the elevator installation has been ascertained. Since safety brakes can certainly require a high level of resetting energy or force, a first start-off is possibly not sufficient.

Figure 5:
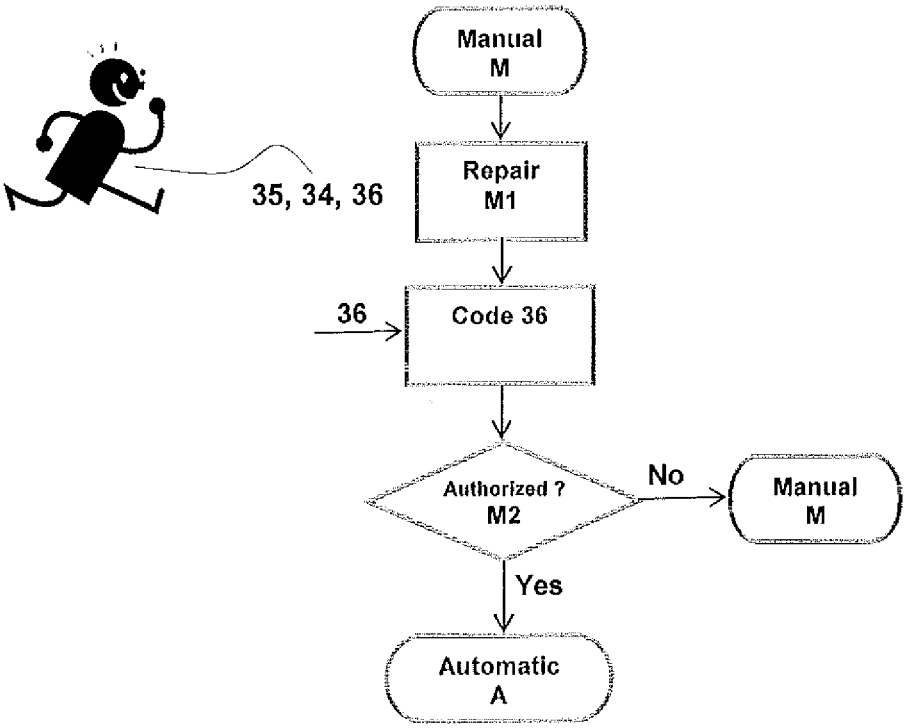
FIG. 5 shows a schematic flow chart for manual initiation of resetting.

As already mentioned, the detection of unsafe states or departures from anticipated behavior lead to termination or non-starting of the automatic resetting A. In these cases, manual resetting M has to be carried out, as is schematically illustrated in FIG. 5. For this purpose, an authorized person 35 is summoned. This summons is carried out by way of known service channels, either electronically targeted by the elevator control or, for example, telephonically by persons concerned. The authorized person in a first step undertakes requisite expert diagnoses of the elevator installation and instigates possible repairs Ml. As soon as at least the primary functions and safety of the elevator installation are given, the authorized person performs, for example, the resetting steps R by manual control. The person switches on the holding current circuit of the retaining device 28 and possibly bridges over the brake safety circuit 23. He or she subsequently moves the elevator cage, for example through use of a so-called inspection control, in the first travel direction until he or she ascertains a small clamping resistance. He or she subsequently moves the elevator cage downwardly against the first travel direction until the elevator cage runs freely. He or she subsequently performs obviously appropriate final checks on the elevator installation before releasing the elevator installation again for normal use.

Alternatively, the authorized person 35 starts resetting through input of an authorization code 36 into the elevator control. The authorization code 36 signals to the elevator control 10 that the person 35 is, in fact, authorized to initiate an appropriate chain of commands. The authorization code 36 can, for example, correspond with a part of an identification number of the brake control. Alternatively, a pre-defined command and action cycle can also be executed in agreement. This is, for example, a command by way of a control keyboard of the elevator control followed by a reset command of the elevator control within a time window of, for example, 10 seconds. These authorization checks can prevent spurious manipulations by the public.

Alternatively, the authorization code 36 includes a possibly personal key 34 which is connected with the brake control 11 or the elevator control 10. The key can be a mechanical key by which access to specific functions of the elevator is made possible. It can also be an electronic key, such as an electronic card, etc., by which access to specific functions of the elevator is made possible. Through use of the key 34 the bearer thereof is identifiable.

After input of the authorization code 36 the brake control 11 or the elevator control 10 checks the authorization M3 and in the case of a successful check initiates automatic resetting A as previously described. A negative check result here can lead back to termination of automatic resetting.

The illustrated embodiments and sequences can be varied. The association of individual functions with the elevator control 10 or brake control 11 can be exchanged or all functions can be combined in a control group. The authorization check M3 can also be used for other part steps of the elevator maintenance such as, for example, for authorizing performance of test activities at the brake control 11 or the safety brakes 20.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

We claim:

1. A method of resetting a released safety brake of a travel body of an elevator installation, the safety brake comprising a retaining device that releases the safety brake when the retaining device is in a deactivated state, the method comprising:

activating the retaining device to prepare the retaining device for holding the safety brake in a readiness setting;

at least partly tightening or re-tightening the safety brake by moving the travel body in a first travel direction; and bringing the safety brake into the readiness setting by moving the travel body in a second travel direction, the second travel direction being opposite the first travel direction, the activating the retaining device being performed before the moving the travel body in the second direction.

2. The method of claim 1, the retaining device being an electromechanical retaining device.

3. The method of claim 1, the first travel direction being a downward travel direction and the second travel direction being an upward travel direction.

4. The method of claim 1, the activating the retaining device being performed before the moving the travel body in the first travel direction.

5. The method of claim 4, the moving of the travel body in the first travel direction being performed until the safety brake at least partially clamps on a brake surface of a brake rail or of a guide rail.

6. The method of claim 5, the at least partial clamping on the brake surface being determined by detecting a travel path of the travel body and comparing the detected travel path with a travel target preset.

7. The method of claim 5, the at least partial clamping on the brake surface being determined by detecting a drive torque of a drive engine and comparing the detected drive torque with a target torque.

8. The method of claim 5, the at least partial clamping on the brake surface being determined by detecting a time duration for movement of the travel body in the first travel direction and comparing the detected time duration with a limit time value.

9. The method of claim 4, the moving of the travel body in the second travel direction being performed until the safety brake is reset, the resetting of the safety brake being determined by a closing of a brake safety circuit and by the travel body having covered a pre-defined travel path.

10. The method of claim 4, the moving of the travel body in the second travel direction being performed until the safety brake is reset, the resetting of the safety brake being determined by a closing of a brake safety circuit and by a drive torque of a drive engine attaining an indicator value.

11. The method of claim 10, further comprising terminating movement of the travel body in the second travel direction when the drive torque of the drive engine has reached a maximum limit value, when the drive torque of the drive engine has exceeded a working limit value during a time limit, when a time limit is reached, when limit positions of the travel body in an elevator shaft are passed, or when an elevator safety circuit detects an unsafe state.

12. The method of claim 1, further comprising:

monitoring the readiness setting; and closing a brake safety circuit when the safety brake is in the readiness setting and when the retaining device is activated.

13. The method of claim 1, further comprising:

monitoring the readiness setting; and interrupting a brake safety circuit when the safety brake is not in the readiness setting.

14. The method of claim 1, further comprising:

checking an elevator safety circuit before the moving the travel body in the first travel direction; and determining that the elevator safety circuit is in order.

15. The method of claim 1, the method being automatically initiated when the retaining device has been deactivated as a result of a non-critical event, when a functional readiness report of a brake control is present, and when an elevator safety circuit designates the elevator installation as safe.

16. The method of claim 1, the method being initiated manually.

17. The method of claim 16, further comprising determining that a person is authorized to manually initiate the method.

18. The method of claim 16, further comprising:

manually confirming a status of the brake control;

manually moving the travel body in the first travel direction using an elevator drive; and manually moving the travel body in the second travel direction using the elevator drive.

19. An elevator installation safety device, comprising:

a safety brake for a travel body, the safety brake comprising a retaining device that releases the safety brake for braking when the retaining device is in a deactivated state;

an elevator control that initiates an automatic resetting of the safety brake when the safety brake has been released for braking as a result of a non-critical event, the automatic resetting comprising, activating the retaining device to prepare the retaining device for holding the safety brake in a readiness setting, at least partly tightening or re-tightening the safety brake by moving the travel body in a first travel direction, and bringing the safety brake into the readiness setting by moving the travel body in a second travel direction, the second travel direction being opposite the first travel direction, the activating the retaining device being performed before the moving the travel body in the second direction.

20. The elevator installation of claim 19, the retaining device being an electromechanical retaining device.

* * * * *